US005396994A

United States Patent [19]

Fitzgerald

[11] Patent Number: 5,396,994

[45] Date of Patent: Mar. 14, 1995

[54] CAP STORAGE AND DISPLAY DEVICE

[76] Inventor: Robert C. Fitzgerald, Rte. 1, Box 139, Middleburg, Va. 22117

[21] Appl. No.: 828,684

[22] Filed: Jan. 31, 1992

[51] Int. Cl.[6] ..... A47F 7/00

[52] U.S. Cl. ..... 211/32; 211/30; 211/87; 211/89; 248/309.1

[58] Field of Search ..... 211/30, 32, 33, 87, 211/89; 248/309.1

[56] References Cited

U.S. PATENT DOCUMENTS

| | | | |
|---|---|---|---|
| 17,098 | 2/1887 | Palmenberg | 211/30 |
| 330,497 | 11/1885 | Lash . | |
| 348,983 | 9/1896 | Mack et al. | 211/32 |
| 384,194 | 6/1888 | Danner | 211/32 |
| 405,729 | 6/1889 | Gardner | 211/32 |
| 639,050 | 12/1899 | Hurdel | 211/30 |
| 1,361,841 | 12/1920 | Etchells | 211/30 |
| 1,445,743 | 2/1923 | Booth | 211/30 |
| 2,213,677 | 8/1939 | Miller | 211/30 |
| 2,258,873 | 10/1939 | Williams | 211/30 |
| 3,173,545 | 3/1965 | La Mar | 211/87 X |
| 3,367,509 | 2/1968 | Cabe | 211/87 |
| 4,673,153 | 6/1987 | Hilty et al. | 211/30 X |
| 5,038,941 | 8/1991 | Bastiaansen | 211/89 X |
| 5,137,157 | 8/1992 | Lawson | 211/32 |
| 5,188,325 | 2/1993 | Hilty et al. | 211/32 X |

OTHER PUBLICATIONS

Sales Brochure from Carol Wright Gifts, Dept. E310 340 Applecreek Road, P.O. Box 8506, Lincoln, Nebr., 68544.

Sales Brochure from Harriet Carter, Box 1181, North Wales, Pa., 19454.

*Primary Examiner*—Robert W. Gibson, Jr.

*Attorney, Agent, or Firm*—Lowe, Price, LeBlanc & Becker

[57] ABSTRACT

A device for displaying one or more caps thereon. The combination of a slot and recess, for example a hole, accommodate an upper portion of a cap provided with a button and with the rear half of the cap folded into the front half of the cap when mounted on the device.

13 Claims, 1 Drawing Sheet

CAP STORAGE AND DISPLAY DEVICE

BACKGROUND OF THE INVENTION

1. Field of the Invention

This invention relates to a device for stacking caps for storage and display purposes.

2. Prior Art

There presently exists a device on the market for displaying caps. In this device, there are a plurality of supports for each gripping the button of a cap. Specifically, the support is provided with an end having a "V"-shaped forked groove. When mounting a cap on the support, the ends of the support are slid between the button and the upper portion of the cap with the groove accommodating the fastener attaching the button to the cap.

Through repeated mounting and dismounting of a cap on this device, the tips of the support can wear and eventually cut the material covering the cap, particularly the material covering the button, since the undersupport of the button itself has a hard surface which acts as an anvil for the cutting action. This effect destroys the appearance and value of the cap. Further, this device does not hold caps securely which permits caps to be inadvertently knocked off when removing an adjacent cap.

SUMMARY OF THE INVENTION

An object of the present invention is to provide an improved cap storage and display device.

Another object of the present invention is to provide an improved cap display device having mount means that adequately supports a cap being displayed, however, prevents wear from repeated mounting and dismounting of the cap on the device.

A further object of the present invention is to provide a cap display device for displaying a plurality of caps in a vertical manner using a minimum of space.

An still further object of the present invention is to provide a cap display device having a mounting structure defined by a slot extending from the front to the rear along the sides of the device in combination with a recess for accommodating the button of the cap while gripping portions of the cap on either side of the button.

The cap display device according to the present invention can take on a number of different forms including single cap displays or plural cap displays. Typically, it is desirable to display a plurality of caps, since it is common to have cap collections known as "logo caps" by individuals wishing to display a plurality of caps at one location such as a family room or study of a home. Various orientations of the display device are possible, however, the vertical array is the most preferred due to its attractive appearance when it is fully mounted with caps and its space saving arrangement in a room, where such displays are commonly mounted.

The display device according to the present invention can be mounted from the wall, ceiling or floor of a room, or upon a stand, in particular an upper portion of a wall in a vertical orientation of the array.

One embodiment of the cap displaying device according to the present invention is defined by an elongated member to be mounted in a substantially vertical orientation. The elongated member such as a length of plastic, metal or wood stock material is provided with a plurality of spaced apart slots extending from the front and along the sides to the rear of the device. In addition, a recess extending from the front of the elongated member is provided substantially at each slot to accommodate the buttons on the top of the caps when mounted on the display device.

The recess at each groove, for example a hole, can be positioned above each slot and centered in the front width of the elongated member. Alternatively, the hole can be centered in the slot.

The cap displaying device according to the present invention can be mounted on room structure in various ways, or independent stand. In one embodiment, the beam is sufficiently thin at its end sections to allow fasteners such as screws and/or nails to pass through holes for mounting in a vertical array on a wall.

DETAILED DESCRIPTION OF PREFERRED EMBODIMENTS

Figure 1:
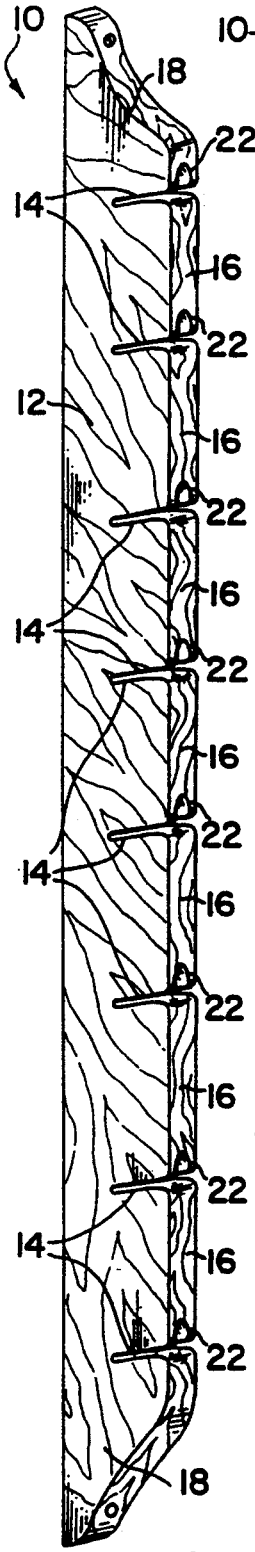
FIG. 1 is a perspective view of an embodiment of the cap displaying device according to the present invention mounted on a wall for display a vertical array of caps.

A perspective view of a cap stacking device 10 according to the present invention is shown in FIG. 1. The device is elongated and mounted in a vertical manner, for example, on a wall.

The cap stacking device 10 can be made of wood, metal, plastic, and/or other suitable materials. For example, the device 10 can be made from a length of $1\frac{1}{2}\times2\frac{1}{2}$ inch lumber and cut with a saw to produce the features of the device to be described in detail below. Alternatively, the device 10 can be made of injection molded plastic.

The device 10 comprises an elongated member 12 having a plurality of spaced apart slot 14 positioned along the front and length of the elongated member 12. The slots 14 define middle sections 16 and end sections 18 of the elongated member 12.

The middle sections 16 are generally the same length to accommodate similar height caps, however, it is possible to vary the lengths of the middle sections 16 to accommodate various height caps at different locations. Further, the end sections 18 can have an ornamental design such as the classic curvature shown in FIG. 1 to enhance the aesthetic looks of the device 10.

Figure 2:
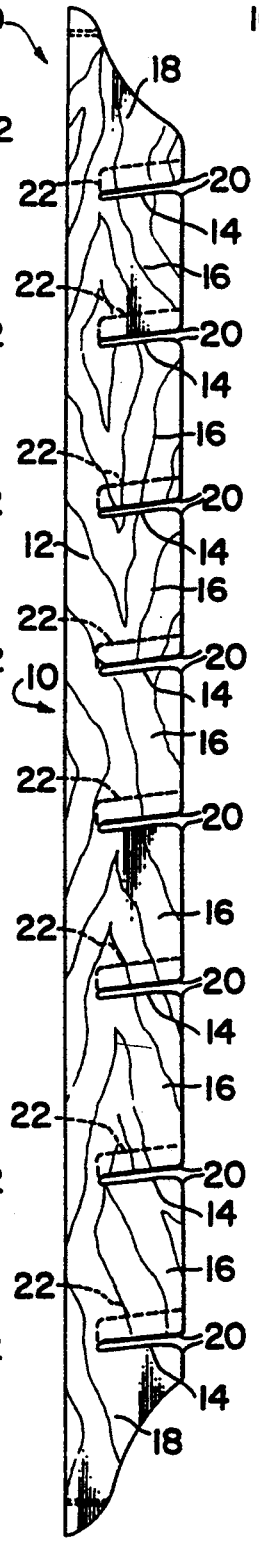
FIG. 2 is a side elevational view of the device shown in FIG. 1.

The slots 14 extend from the front of the elongated member 12 to a preselected distance towards the rear and along the sides of the elongated member 12. Preferably, the slots taper from the front towards the rear in order to accommodate caps having different weights of material (i.e. different mounting thicknesses). As shown in FIG. 2, the opening to each groove 14 is preferably beveled or rounded at 20 to facilitate mounting a cap on the cap displaying device 10. Preferably, the slots 14 slope slightly downwardly from the front of the device 10 in order to improve the holding effect on the cap.

The front of the elongated member 12 is provided with a plurality of recesses, such as holes 22, at or near the openings into the slots 14. The recesses are of a sufficient size and shape so as to accommodate the buttons of the caps mounted on the device 10. Preferably, the size and shape of the recesses are selected to accommodate the maximum sized button on conventional caps sold and marketed to be universal in nature.

Figure 3:
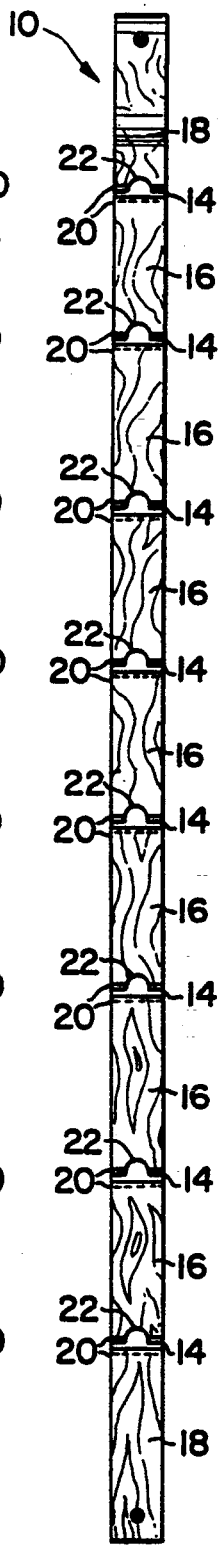
FIG. 3 is a front elevational view of the device shown in FIG. 1.
Figure 4:
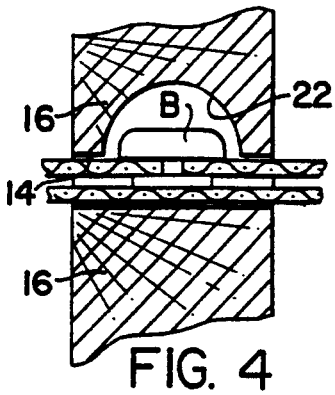
FIG. 4 is a blown-up detailed front view of the cap mounting structure of the device shown in FIG. 1.
Figure 5:
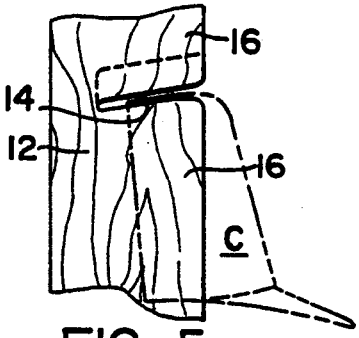
FIG. 5 is a side view illustrating a cap mounted on the device shown in FIG. 1.
Figure 6:
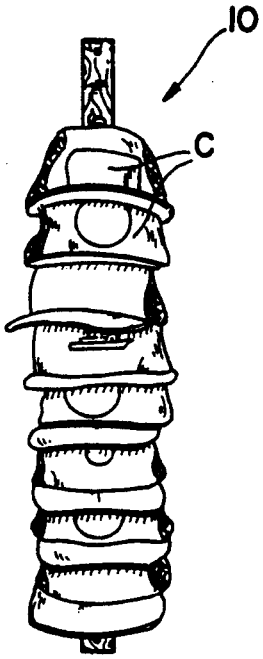
FIG. 6 is a front view of the device with a vertical array of caps stacked thereon.

The holes 22 can be centered in the grooves 14, but are preferably positioned off-center and above the grooves 14 to provide a configuration most suitable for accommodating the button B of a cap, as shown in FIGS. 3 and 4. Further, the length of holes 22 are preferably approximately the same or greater than the length of the grooves 14 in order to accommodate buttons on caps having a lower fabric weight that allows the overlapped material to be pulled to the very ends of the slots 14.

The holes 22 are preferably provided at the same slight downward angle as the groove from the front of the cap displaying device 10. The angle of the hole will cause the button to move further into the hole by the weight of the cap when mounted. This will ensure that the cap will remain mounted on the cap display device during operation, and prevent inadvertent removal therefrom, for example, by a person bumping against a cap mounted on the device.

OPERATION

The cap storage and display device shown in the figures can be mounted to a wall prior to use, for example, with nails, screws or other suitable anchors.

A cap is mounted on the device by folding the rear half of the cap into the front half of the cap. A person loading the cap grips the cap on either side of the button looking at the front of the cap. Specifically, the person grips the material on either side of the button with his or her fingers and then moves this portion of the cap towards one of the slot/hole combinations. The button is centered in front of the hole and the person moves the gripped material on either side of the button into the slot, thus, causing the button to enter the hole. The person pulls the material rearward deeper into the slot until the edges of the slot sufficiently clamp the material due to the tapering configuration of the slot. To remove the cap the procedure is reversed.

EXAMPLE

A length of wood stock $1\frac{1}{8}$ to $1\frac{1}{2}$ inch wide (front view) and 2 to $2\frac{1}{2}$ inch deep (side view) is provided for making a device according to the present invention.

The length of the device will vary depending on the number of caps to be stored on the cap display device. Three (3) inches should be allowed for each cap as well as for each end for shaping or tapering.

For each cap, a $\frac{5}{8}$ inch hole is drilled at a 7 degree downward slope, centered at the front width of the device. The hole is drilled to a depth of $1\frac{1}{2}$ inches. A slot is cut across the face of the device transverse to the length thereof. The slot is aligned with the bottom of each hole and at the same 7 degree angle for the depth of the hole. Further, the slot is cut so as to taper from a $\frac{1}{4}$ inch in thickness at the front to a $\frac{1}{8}$ inch thickness at the end of the slot.

Each slot is beveled at the top and bottom of the opening to permit easy insertion and removal of the folded cap in and out of the slot. The angle of the slot and hole prevents accidental dislodging of the caps once mounted on the device.

The top part of the drilled hole accepts the button on top of the cap without damage to the button or cap. The top and bottom ends of the device are beveled or curved to permit screw holes for affixing the device to a wall or other vertical surface as well as for aesthetic purposes.

I claim:

1. A cap storage and displaying device, comprising:

a support having a front and sides, said support being provided with a substantially horizontally oriented slot separating first and second sections and extending from the front and along a portion of the sides to a predetermined depth in said support, said support being provided with a recess substantially at said slot for accommodating a button of the cap which has been previously folded with the rear half of the cad folded into the front half of the cap, said recess extending from a surface of one of said sections forming one side of said slot, to a bottom of said recess, terminating at a position within said one of said sections, wherein the material on either side of the button is held by edges of the slot when the cap is mounted onto the support by a person gripping the material on either side of the button and pulling the material deeper into the slot until the edges grip the cap.

2. A device according to claim 1, wherein said recess is a hole provided substantially at said slot.

3. A device according to claim 1, wherein said recess is provided slightly above and overlapping a portion of said slot.

4. A device according to claim 2, wherein said hole has a length at least as great as the depth of the slot.

5. A device according to claim 1, wherein said slot is sloped at a slight downward angle from the front of the device.

6. A device according to claim 5, wherein said angle is approximately seven (7) degrees.

7. A device according to claim 2, wherein said hole is sloped at a slight downward angle from the front of the device.

8. A device according to claim 7, wherein said slot is sloped at a slight downward angle from the front of the device.

9. A device according to claim 1, wherein an opening of said slot is beveled to facilitate insertion of material on either side of the button of the cap into the slot.

10. A cap storage and displaying device for mounting on a support such as a wall or stand, comprising:

an elongated member to be mounted in a substantially vertical orientation on the support, said elongated member having a front and sides, said elongated member being provided with a plurality of substantially horizontally oriented slots spaced apart along the length of said elongated member, said slots extending from the front and along a portion of the sides to a predetermined depth in said elongated member; and a plurality of recesses each provided substantially at each slot for accommodating a button of a cap which has been previously folded with the rear half of the cap folded into the front half of the cap, wherein the material on either side of the button is held by edges of the slot when the cap is mounted onto the elongated member by a person gripping the material on either side of the button and pulling the material deeper into the slot until the edges of the slot grip the cap.

11. A device according to claim 10, wherein said recess is a hole provided substantially at said slot.

12. A device according to claim 10, wherein said recess is provided slightly above and overlapping a portion of said slot.

13. In combination, a cap and a cap storage and displaying device, the storage and displaying device including:

a support having a front and sides, said support being provided with a substantially horizontally oriented slot extending from the front and along a portion of the sides to a predetermined depth in said support, said support being provided with a recess substantially at said slot, the recess holding a button of the cap which has been previously folded with the rear half of the cap folded into the front half of the cap, the material on either side of the button being held by edges of the slot, the cap being mounted on the support by a person gripping the material on either side of the button so the material is deep in the slot so the edges grip the material on at least one side of the button of the cap.

* * * * *